US011256201B2

(12) United States Patent
Tadomi

(10) Patent No.: US 11,256,201 B2
(45) Date of Patent: Feb. 22, 2022

(54) FIXING DEVICE WITH ROUGHENING RUBBING MEMBER FOR ENDLESS FIXING BELT

(71) Applicant: CANON KABUSHIKI KAISHA, Tokyo (JP)

(72) Inventor: Takuma Tadomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/006,204

(22) Filed: Aug. 28, 2020

(65) Prior Publication Data

US 2020/0393784 A1 Dec. 17, 2020

Related U.S. Application Data

(63) Continuation of application No. PCT/JP2019/010721, filed on Mar. 8, 2019.

(30) Foreign Application Priority Data

Mar. 9, 2018 (JP) ..... JP2018-042749

(51) Int. Cl.
*G03G 15/20* (2006.01)

(52) U.S. Cl.
CPC ..... *G03G 15/2053* (2013.01); *G03G 15/20* (2013.01); *G03G 15/2064* (2013.01); *G03G 2215/2032* (2013.01)

(58) Field of Classification Search
CPC ..... G03G 15/2053; G03G 15/2064
See application file for complete search history.

(56) References Cited

U.S. PATENT DOCUMENTS 5,262,834 A * 11/1993 Kusaka ..... G03G 15/2003 219/216
7,430,392 B2 9/2008 Ito et al.
7,962,080 B2 * 6/2011 Kameda ..... G03G 15/5029 399/323
8,422,928 B2 * 4/2013 Maruko ..... G03G 15/2035 399/326
8,818,253 B2 * 8/2014 Kimura ..... G03G 15/2053 399/329

(Continued)

FOREIGN PATENT DOCUMENTS

JP 2006-098930 4/2006
JP 2008-040363 A 2/2008

(Continued)

OTHER PUBLICATIONS

International Search Report, dated Apr. 23, 2019, in International Application No. PCT/JP2019/010721.

(Continued)

*Primary Examiner* — Walter L Lindsay, Jr.
*Assistant Examiner* — Milton Gonzalez
(74) *Attorney, Agent, or Firm* — Venable LLP

(57) ABSTRACT

A fixing device includes an endless belt; a driving rotatable member cooperative with the endless belt to form a nip for fixing a toner image on a recording material and for driving the endless belt; an urging member provided inside the endless belt to urge the endless belt toward the driving rotatable member; and a rubbing rotatable member for rubbing an outer surface of the endless belt.

7 Claims, 4 Drawing Sheets

(56) References Cited

U.S. PATENT DOCUMENTS

| | | | | |
|---|---|---|---|---|
| 8,977,172 | B2 * | 3/2015 | Yoshimura | G03G 15/2064 399/320 |
| 9,182,710 | B2 * | 11/2015 | Watanabe | G03G 15/2028 |
| 9,207,600 | B2 | 12/2015 | Chikugo | |
| 9,217,964 | B2 * | 12/2015 | Hatazaki | G03G 15/2025 |
| 9,274,468 | B2 | 3/2016 | Tadomi | |
| 9,639,036 | B2 | 5/2017 | Makino | |
| 9,733,600 | B2 * | 8/2017 | Nozawa | G03G 15/2053 |
| 2004/0052555 | A1 | 3/2004 | Berkes et al. | |
| 2008/0038027 | A1 | 2/2008 | Ito et al. | |
| 2013/0266353 | A1 | 10/2013 | Chikugo | |
| 2013/0272758 | A1 * | 10/2013 | Hayashi | G03G 15/2053 399/329 |
| 2015/0338816 | A1 | 11/2015 | Tadomi | |
| 2016/0216658 | A1 | 7/2016 | Makino | G03G 15/2025 |
| 2018/0059598 | A1 * | 3/2018 | Hasegawa | G03G 15/2028 |
| 2020/0125017 | A1 | 4/2020 | Yasui et al. | |
| 2020/0249597 | A1 | 8/2020 | Tadomi et al. | |
| 2020/0393784 | A1 | 12/2020 | Tadomi | |

FOREIGN PATENT DOCUMENTS

| | | | |
|---|---|---|---|
| JP | 2011-197357 | A | 10/2011 |
| JP | 2013-218053 | A | 10/2013 |
| JP | 2015-138099 | A | 7/2015 |
| JP | 2015-210311 | | 11/2015 |
| JP | 2015-210311 | A | 11/2015 |
| JP | 2017-072637 | | 4/2017 |
| JP | 2018-036616 | | 3/2018 |

OTHER PUBLICATIONS

Office Action dated Dec. 14, 2021 in counterpart Japanese Application No. 2018-042749, together with English translation thereof.

* cited by examiner

FIXING DEVICE WITH ROUGHENING RUBBING MEMBER FOR ENDLESS FIXING BELT

CROSS-REFERENCE TO RELATED APPLICATIONS

This application is a continuation of International Patent Application No. PCT/JP2019/010721, filed Mar. 8, 2019, which claims the benefit of Japanese Patent Application No. 2018-042749, filed Mar. 9, 2018. The foregoing applications are incorporated herein by reference in their entireties.

The present invention relates to a fixing device usable with an image forming apparatus capable of forming an image on a recording material, such as a copying machine, a printer, or a facsimile which employs an electrophotographic method.

In the fixing device, unevenness of gloss may occur due to a difference in a surface state of a fixing roller between a paper passing area and a non-paper-passing area by repeated passages of the recording materials in a fixing process. Specifically, burrs (paper edges) exist at edges of the recording sheet by cutting in sheet production process. When the burr contacts the fixing roller when the recording material passes through the fixing device, a slight scratch (edge damage) is produced on the surface of the fixing roller. When the fixing process of the recording material of the same size (small size, for example) is repeated, the edge scratches are repeatedly formed at the same position in a longitudinal direction of the fixing roller.

As a result, the surface state of the fixing roller differs between the paper passing area and the non-paper-passing area, and when a fixing process of a large-sized recording material is performed, the surface state of the fixing roller due to the edge scratch is transferred onto the image, with the result that it may be visually recognized as stripes due to uneven gloss or difference in gloss.

As a method of suppressing image defects due to such uneven gloss, the surface roughness of the fixing member can be adjusted in the longitudinal direction by pressing a rubbing rotatable member having abrasive particles adhered to the surface, against the surface of the fixing member to rub it. It is known to make the state as uniform as possible to suppress the occurrence of the above-mentioned defective image (Japanese Laid-open Patent Application No. 2008-040363).

Conventionally, such a rubbing rotatable member has been used for a fixing device which is required to have high productivity and high image quality, so as to rub the surface of a fixing roller or a fixing belt which is stretched and supported by a plurality of rollers.

By the way, a fixing device using a fixing film (endless belt) having a relatively smaller heat capacity is known and used for the purpose of shortening the startup time of the fixing device and saving energy. In such a fixing device, the fixing film is not stretched by a plurality of rollers but is supported by a supporting member provided at an end of the fixing film.

Even in such a fixing device, further improvement in image quality is desired, specifically, it is required to be able to provide a high-quality product in which the gloss of the image is uniform.

According to an aspect of the present invention, there is provided, there is provided a fixing device comprising an endless belt; a driving rotatable member cooperative with said endless belt to form a nip for fixing a toner image on a recording material and configured to drive said endless belt;

an urging member provided inside said endless belt and configured to urge said endless belt toward said driving rotatable member; and a rubbing rotatable member configured to rub an outer surface of said endless belt.

DESCRIPTION OF THE EMBODIMENTS

Hereinafter, preferred embodiments of the present invention will be described in detail with reference to the accompanying drawings. However, the components described in this embodiment are merely examples, and the present invention is not limited to those described in the embodiment.

Embodiment 1

(Image Forming Apparatus)

Figure 1:
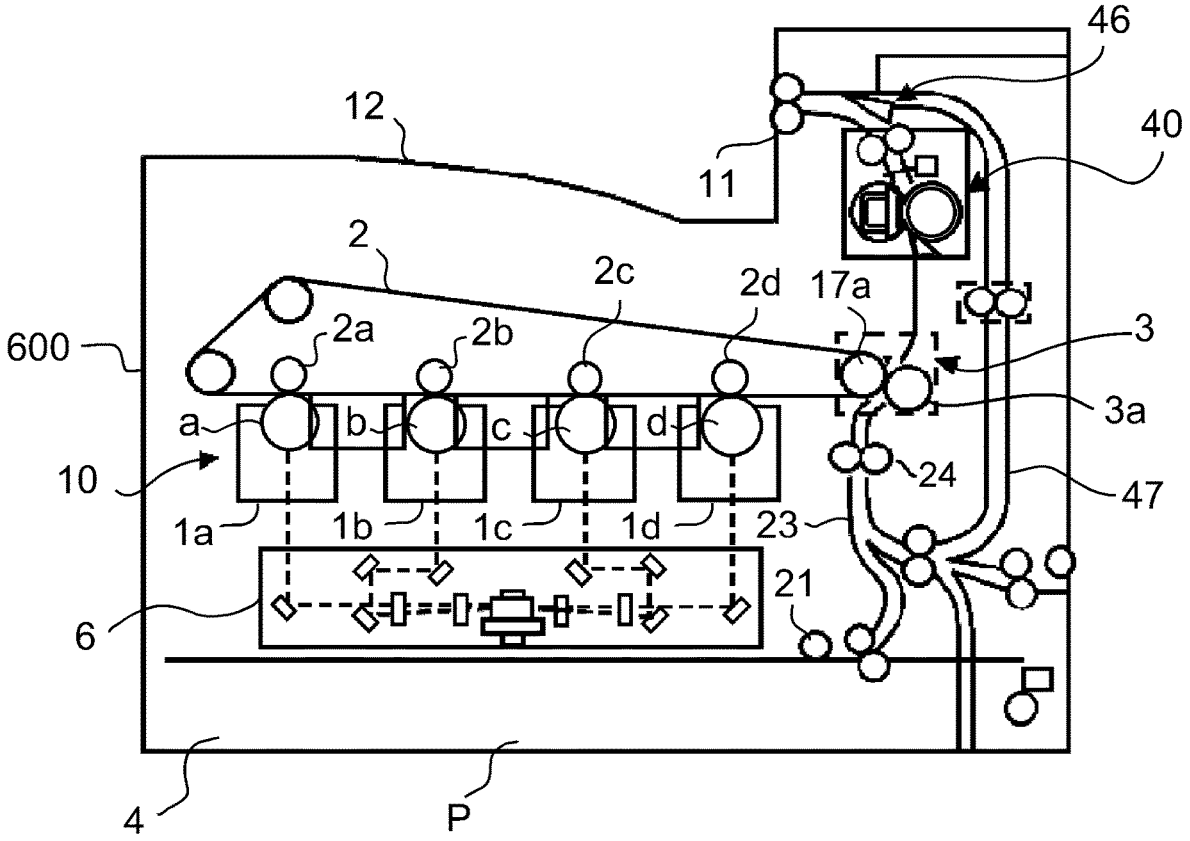
FIG. 1 is a schematic sectional view illustrating an example of an image forming apparatus equipped with a fixing device according to an embodiment of the present invention.

FIG. 1 shows a tandem type digital color copying machine (hereinafter, simply referred to as a copying machine) as an image forming apparatus, and is a schematic cross-sectional view of a structure along a feeding direction of a sheet P as a recording material (recording paper). On the sheet P, a toner image (toner image) is formed. Specific examples of the sheet P include plain paper, a resin sheet as substitute for plain paper, thick paper, and a sheet for an overhead projector. In this embodiment, the image forming apparatus will be described by way of example of an apparatus including an image forming unit of a full-color intermediary transfer system, but the present invention is not limited to this.

For example, it may be a direct transfer type device which transfers from the photosensitive drum 1 directly to a recording material without using an intermediary transfer film 2, as will be described hereinafter, or a device which forms a monochromatic toner image (monochrome machine, for example). Further, the image forming apparatus may be a copying machine, a printer, a facsimile machine, or a multi-function machine having a plurality of these functions.

The main structure of the copying machine will be described below referring to FIG. 1. The engine unit 600 of the copying machine includes an image forming portion 10 for each color of Y (yellow), M (magenta), C (cyan), and Bk (black), and includes image forming units 1*a*-1*d*. The photosensitive drums a-d are charged in advance by a charger, and then the laser scanner 6 forms a latent image of the original image data red from the image reading portion 601. The latent image is visualized into a toner image by the developing device. The toner images on the photosensitive drums a to d are sequentially transferred by the primary transfer rollers 2*a* to 2*d*, for example, an intermediary transfer belt 2 which is an image bearing member. The intermediary transfer belt 2 is entrained around plural tension rollers including tension roller 17*a*.

On the other hand, the sheets P are fed out one by one from a sheet feed cassette 4 by feed roller 21, pass through a feed path 23, and are fed to the registration roller pair 24. The registration roller pair 24 once stops the sheet P and straightens the sheet P when the sheet P is oblique. Then, the registration roller pair 24 sends the sheet P to a secondary transfer portion 3 between an intermediary transfer belt 2 and a secondary transfer roller 3*a* in synchronization with the toner image on the intermediary transfer belt 2.

The color toner image on the intermediary transfer belt 2 is transferred onto the sheet P by a transfer member such as a secondary transfer roller 3*a*. After that, the toner image on the sheet P passes through the pre-fixing feeding path and is fixed on the sheet P by being heated and pressed by the fixing device 40.

When the toner image is to be formed on only one side of the sheet P, the sheet P is discharged to the sheet discharge tray 12 by way of the sheet discharge roller 11 by switching the switching flapper 46. When a toner image is formed on each side of the sheet P, the sheet P carrying the toner image fixed by the fixing device 40 is fed to the sheet discharge roller 11. Then, when the trailing edge of the paper reaches the reversal point, it is switched back by a reverse rotation of the sheet discharge roller 11, passes through a double-sided feeding path 47, and then undergoes the same process as single-sided image formation, and then a toner image is formed on the other side of the sheet, and thereafter, the sheet is discharged to the sheet discharge tray 12.

The portion constituted by the switchback operation of the flapper 46 and the paper discharge roller 11 is an example of a reversing portion. In this embodiment, the paper is reversed by the paper discharge roller 11, but in order to improve the productivity of printing, a reverse portion is provided, a plurality of paper discharge portions are provided, and so on to effect the reversing operation at a position other than the discharge roller.

(Fixing Device)

Figure 2:
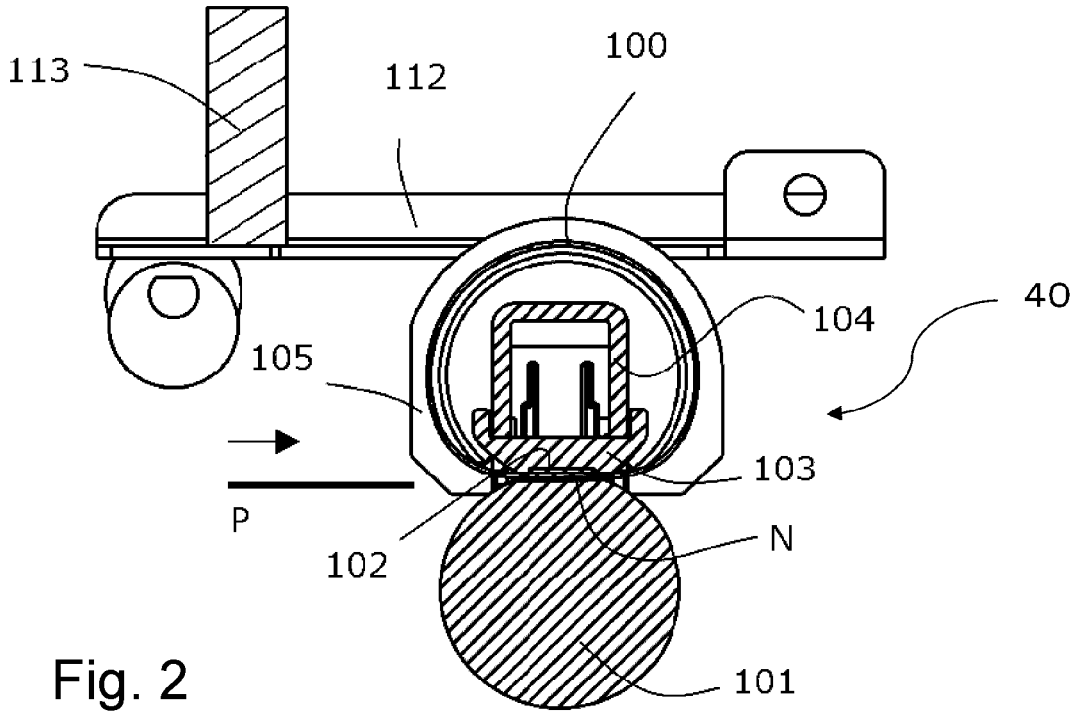
FIG. 2 is a sectional view illustrating an example of the fixing device according to the embodiment of the present invention.

Referring to FIGS. 2 to 6, the structure and mechanism of the fixing device 40 will be described. First, FIG. 2 is a schematic cross-sectional view in which only the portion for performing the fixing operation is extracted in this structure. The fixing device 40 in this embodiment is a film heating type and pressure roller driving type fixing device using a fixing film (endless belt) 100 including a cylindrical metal base layer and an elastic layer is formed thereon.

The fixing device 40 includes a thin hollow endless fixing film 100, and a pressing roller 101 which forms a fixing nip portion N in cooperation with the fixing film 100 and which is pressed against the fixing film by a pressing spring 113 and a pressing lever 112. Pressing lever 112 is pivoted around shaft 111. Further, on the inner peripheral side of the fixing film 100, there are a pressure contact member 103 and a heating member 102 which are in cooperation with the pressure roller 101 while sandwiching the fixing film 100 therebetween.

The fixing film 100 is supported by a fixing frame 115 (FIG. 5) by way of a stay 104 and a film supporting member 105, and is pressed against the pressing roller 101 by the pressing lever rotatably supported by the fixing frame and the pressing spring 113. In this embodiment, the applied pressure is 125 N on one end side and the total applied pressure is 250 N.

A lubricant (not shown) is previously applied to the sliding surfaces of the fixing film 100 and the pressure contact member 103 in order to reduce friction therebetween. A lubricant is similarly applied beforehand to the sliding surfaces of the fixing film 100 and the heating member 102 in order to reduce the friction therebetween. In this embodiment, the lubricant is oil. The oil is preferably silicone oil or the like which can be usable under a high temperature environment.

The fixing film 100 is sandwiched between the pressure contact member 103 and the pressure roller 101 with a predetermined pressure. The pressure roller 101 is rotationally driven by a fixing motor (not shown) and a fixing driving portion (not shown), and the fixing film 100 is rotated by this.

The heating member 102 includes a heating element (resistive heating element) as a heat source which generates heat when electric power is supplied, and the temperature of the heating member 102 is raised by the heat generated by the heating element. By passing the sheet P between the fixing film 100 and the pressure roller 101, the sheet is supplied with thermal energy from the heating member 102 through the fixing film 100 while the sheet P is nipped and fed in the fixing nip portion N. Then, the unfixed toner image (not shown) on the recording material is fixed by heat and pressure, and the sheet P passes through the fixing nip portion N, and then is separated from the fixing film 100 and discharged. In FIG. 2, reference numeral 104 depicts the stay, and reference numeral 105 depicts the film support member.

(Fixing Film)

In order to reduce the heat capacity and improve the quick start property, the fixing film 100 is made of a heat resistant resin such as a polyimide film or a PEEK (or a metal such as SUS or Ni) film having a total thickness of 150 μm or less. An elastic layer made of a rubber material having a high thermal conductivity is formed on a resin layer given an electroconductivity so as to provide a high thermal conductivity, and a release layer of a fluororesin is formed on the surface to form an endless shape with an inner diameter of 25 mm. In this embodiment, a polyimide having a thickness of 30 μm is used for the base layer, a silicone rubber having a thickness of 70 μm and a thermal conductivity of 1.0 W/m·K is used for the elastic layer, and a PFA tube having a thickness of 30 μm is used for the release layer.

The PFA layer is preferably a sheet or a coat layer having high releasability, and a fluororesin layer, for example, can be used. Further, the fixing film may comprise a sheet-shaped member having high heat resistance represented by polyester, polyethylene terephthalate, polyimide amide or the like as a base layer, a conductive layer formed on the base layer, and a surface release layer laminated on the conductive layer. (Pressure roller)

The pressure roller 101 is supported by the fixing frame 115 (FIG. 5) by way of pressure roller bearings (not shown) provided at opposite ends in the longitudinal direction. The pressure roller includes a cylindrical core bar made of metal such as iron or aluminum as a core material, an elastic layer of a soft rubber material such as sponge or silicone rubber on the outer peripheral side of the core bar, and a PFA layer as a surface release layer.

In this embodiment, the surface of a core metal of iron, aluminum or the like is subjected to surface roughening treatment such as blasting and then washed, and then the core bar is inserted into a cylindrical mold, liquid silicone rubber is injected into the mold, and it is heat-cured. At this time, in order to form a resin tube layer such as a PFA tube on the surface layer of the pressure roller 101 as a release layer, a tube having a primer coated on the inner surface is inserted into the mold in advance, by which the heat-curing of the rubber and the boding between tube and rubber layer are effected simultaneously. The pressure roller molded in this manner is subjected to a demolding treatment and then is subjected to secondary vulcanization.

In this embodiment, the pressure roller 101 has a core metal diameter of 15 mm, the silicone rubber as the elastic layer has a wall thickness of 5 mm and an Asker hardness of 64°, the PFA tube of the release layer has a thickness of 50 μm, and the pressing roller has an outer diameter of about 25 mm.

(Heating Member)

The heating member 102 is a ceramic heater (hereinafter referred to as a heater). The heating member 102 is a heating element provided by printing a thick film of Ag/Pd paste on an elongated thin AlN substrate having a high thermal conductivity and by firing the paste. Then, a ceramic heater is integrally formed on the heating element with a glass coating layer having a thickness of about 50 to 60 μm as a sliding insulating member. In this embodiment, the heating resistance layer is formed on the AlN substrate having a thickness of 600 μm.

On the other hand, a chip thermistor is provided on the side of the substrate opposite to the side on which the heating element is provided, with the AlN substrate interposed therebetween. The thermistor monitors a temperature of the AlN substrate. Further, a thermistor is also provided at a position in the neighborhood of the end of the heating element. The thermistor is fixed to the substrate with a predetermined pressure by a pressing means such as a sprig (film support member)

At each of the opposite ends, in the longitudinal direction, of the fixing film 100, there is provided a film support member 105 having a regulation surface (regulating portion) which supports the fixing film 100 and regulates the movement of the fixing film 100 in the longitudinal direction and having a surface (guide portion) which regulates the shape of the film in the circumferential direction. More particularly, a first support member is provided on one end side of the fixing film 100 in the longitudinal direction to guide the one end portion side of the fixing film 100 by a first guide portion. Further, a second support member is provided on the other end side of the fixing film 100 in the longitudinal direction to guide the the other end portion side of the fixing film 100 by a second guide portion.

In this embodiment, the surface which regulates the circumferential shape of the film support member 105 is provided inside (the inner peripheral side) of the fixing film 100, and has a function of a guide which guides the inner peripheral surface of the fixing film 100. Further, the film support member 105 is provided at each of opposite ends in the longitudinal direction.

The film supporting member 105 supports the stay 104 disposed inside the fixing film 100 and the pressure contact member 103 for pressing and urging the fixing film 100 toward the pressure roller 101. The film support member 105 is made of a heat-resistant resin such as PPS, liquid crystal polymer, and phenol resin, and receives a pressure while supporting the edge surface of the fixing film 100.

The fixing film 100 is loosely extended on the outside of the pressure contact member 103 and the heating member 102. The film support member 105 which supports the opposite ends of the fixing film 100 in the longitudinal direction is supported by the fixing frame 115 (FIG. 5) so as to be freely movable in the pressing direction.

(Stay)

The stay 104 is a member which receives a reaction force from the pressure roller 101, and is preferably made of a material which does not easily bend even when a high pressure is applied thereto. In this embodiment, stainless steel (SUS304) is used.

(Pressing Member)

The pressure contact member 103 is a nip forming member which fixedly supports the heating member 102. The pressure contact member 103 has a trough shape with a substantially semicircular cross-section, and is a heat insulating member such as a heat resistant resin extending in the longitudinal direction perpendicular to the cross-section of the Figure. From the standpoint of energy saving, it is desirable to use a material having a low heat conduction to the stay 104, and for example, heat resistant glass or heat resistant resin such as polycarbonate or liquid crystal polymer is used. (Roughing roller)

Figure 3:
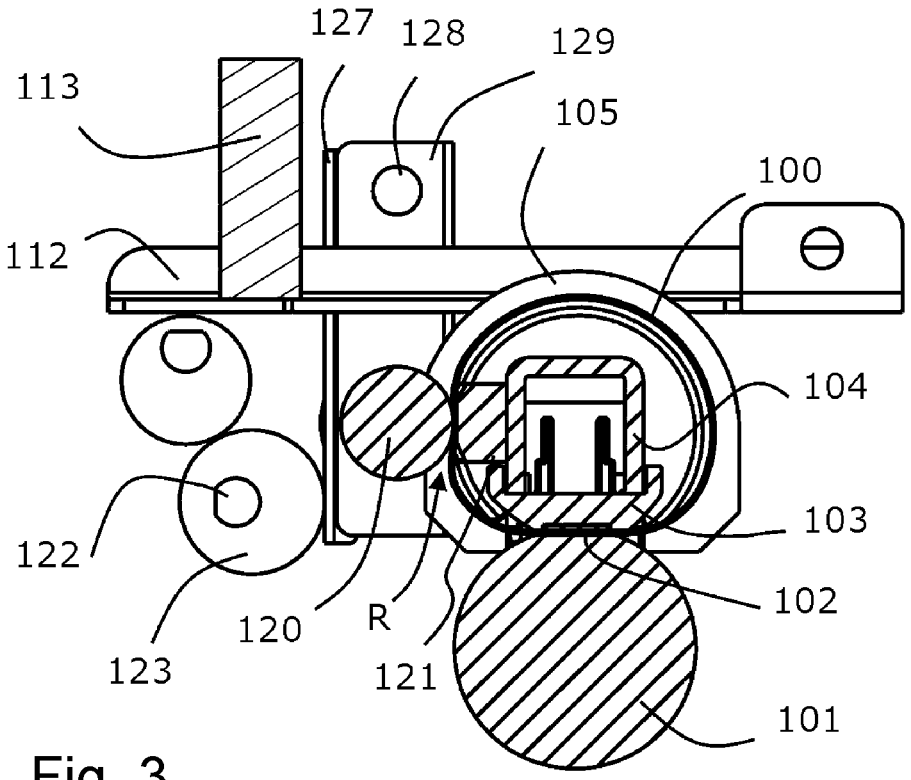
FIG. 3 is a sectional view illustrating a state when the roughening roller contacts.

The roughening roller 120 as a rubbing member (rubbing rotatable member) shown in FIG. 3 is a roller having a certain roughness as a rubbing portion, and is driven by the fixing film 100, or is driven by a driving source. By this, the rubbing portion can be rubbed on the surface of the fixing film 100, and the surface roughness of the fixing film 100 is changed.

Therefore, for the roughening roller 120, for example, abrasive grains are densely adhered to the surface of a stainless core bar having a diameter of 12 mm by an adhesive layer. It is preferable to use abrasive grains having a count (grain size) of #1000 to #4000 depending on a target glossiness of the image. The average grain size of the abrasive grains is about 16 μm when the count (grain size) is #1000, and is about 3 μm when the count is #4000.

The abrasive grains are alumina-based (also referred to as a registered trademark "Alundum" or "Morundum"). Alumina-based material is the most widely used abrasive grain in the industry, and has hardness remarkably higher than that of the surface of the fixing film 100, and has an excellent abrading property because the particles have an acute-angled shape. In this embodiment, abrasive grains of a count (grain size) of #2000 (average grain size of 7 μm) are used. The surface roughness (arithmetic mean roughness, Ra) is 2.0 μm or more and 4.0 μm or less (according to JIS standard), and an average interval (Sm) between concavities and convexities is about 10 μm or more and 20 μm or less (according to JIS standard).

In this embodiment, as the roughening roller 120, the one in which the abrasive grains are densely adhered to the stainless steel core metal by the adhesive layer has been described. The present invention is not limited to this example, and the roughening roller 120 may be one which is provided by processing the surface of a stainless steel core bar into a desired surface property by blasting or the like.

(Contactable and Separable Roughing Mechanism)

Referring to FIGS. 3-6, the description will be made as to the operation of the film roughening mechanism capable of contacting and separating the surface property of the fixing film 100 (sliding treatment), more particularly, the contact or separation relative to the surface (outer surface) of the fixing film 100 In this embodiment, the description will be made using a structure (sliding friction rotatable member) in which the roughening roller 120 functioning as a sliding friction member is rotatable, but the present invention is not limited such an example, and the roughening roller may be fixed (no rotation).

The roughening roller 120, which is a rubbing rotary member constituting the roughening mechanism, is provided at a position close to the fixing film 100 so as to be capable of contacting to and separating from the surface (outer surface) of the fixing film 100. FIG. 3 shows the contact state (contact position), and FIG. 4 shows the separated state (separation position).

Figure 4:
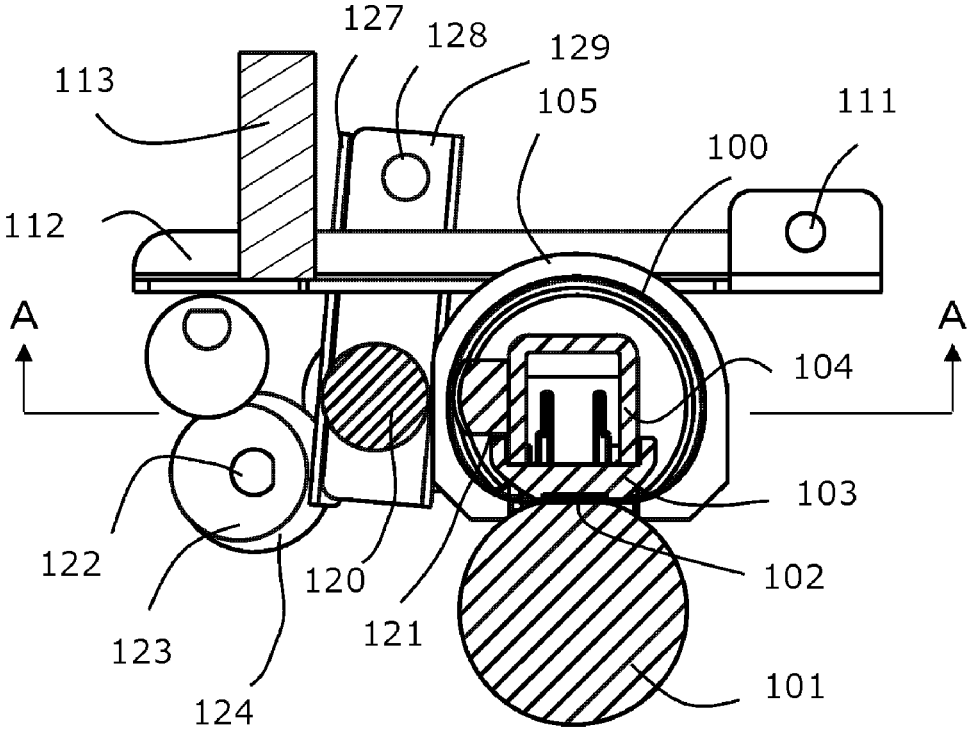
FIG. 4 is a cross-sectional view illustrating a state when the roughening roller are spaced.

In FIG. 3 and FIG. 4, there is provided a moving mechanism, which will be described later, which moves the roughening roller 120 between a contact position where the rubbing portion of the roughening roller contacts the outer peripheral surface of the fixing film 100 and slides against the fixing film 100 and a separation position where the rubbing rotatable member 120 separates from the fixing film 100. When a distance between the rubbing portion of the roughening roller 120 and the outer peripheral surface of the fixing film 100 at the time of the roughening roller 120 being located at the separated position is a first distance, the moving mechanism moves the roughening roller 120 to the contact position by a second distance longer than the first distance.

Figure 5:
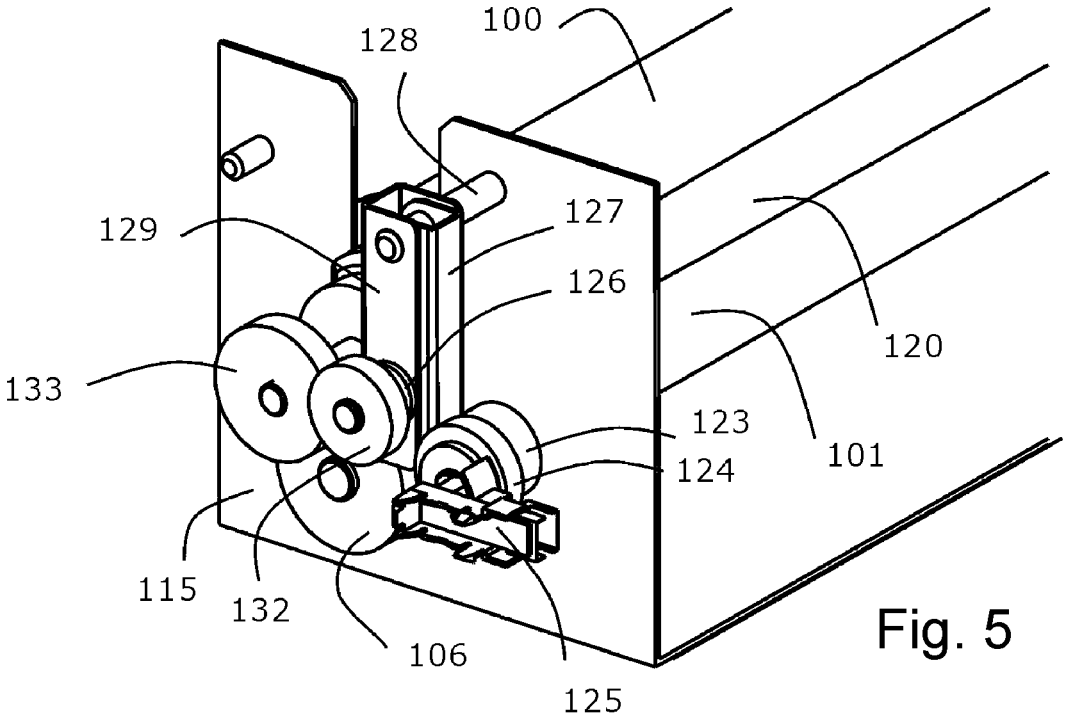
FIG. 5 is a perspective view illustrating a roughening roller constituent portion.

FIG. 5 is a perspective view illustrating a contacts/separation structure and a drive mechanism portion as a moving mechanism for the roughening roller 120. As shown in FIG. 5, roughening roller cams 123 as eccentric cams and roughening roller cam gears 124 are provided at respective axial ends of a roughening roller cam shaft 122 supported by the frame 115 of the fixing device 40. A roughening roller cam motor (not shown) is operated to rotate the roughening roller cam shaft by way of the roughening roller cam gear 124 by a connected drive train, such that the roughening roller 120 is contacted and separated by changing the phase of the roughening roller cam 123.

The phase of the roughening roller cam 123 is controlled by stopping the roughening roller cam 123 at proper positions by using the sensor 125 (FIG. 5) to reliably switch between the contacting and separating states of the roughening roller 120.

In FIG. 5, designated by reference numeral 126 is a roughening roller bearing, reference numeral 127 is a pressure arm for pressing the roughening roller 120, reference numeral 128 is a fixed shaft fixed to the frame 115, and reference numeral 129 is a support arm.

Figure 6:
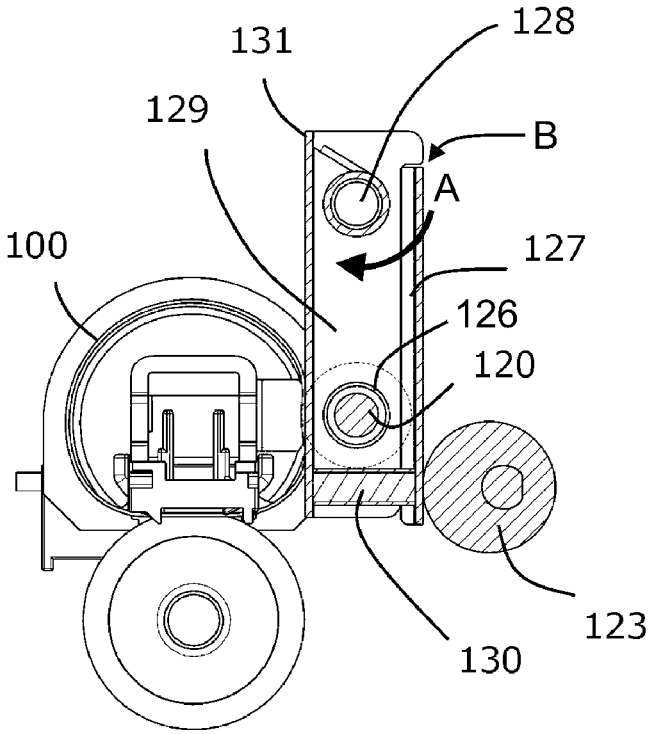
FIG. 6 is a sectional view illustrating a pressing portion of the roughening roller.

Here, referring to FIG. 6, the details of the operation of pressing the roughening roller 120 will be described. FIG. 6 is a cross-sectional view illustrating the pressing portion of the roughening roller 120. The roughening roller 120 is rotatably supported by a support arm 129 rotatably supported with a fixed shaft 128 as a fulcrum position, by way of a roughening roller bearing 126. A pressure arm 127 is rotatably supported also by the fixed shaft 128, and a pressure spring 130 is provided between the support arm 129 and the pressure arm 127.

In FIG. 6, when the roughening roller cam 123 is rotated to press the roughening roller 120 against the surface (outer surface) of the fixing film 100, the pressure arm 127 is pushed down by the roughening roller cam 123 to rotate in the direction of arrow A. When the pressure arm 127 is pushed down, the support arm 129 is pushed down by the pressure spring 130 to starts to rotate in the direction of arrow A in the Figure. Since the support arm 129 supports the roughening roller 120, the roughening roller 120 stops while being pressed against the fixing film 100 with a predetermined pressure. In this way, the roughening roller 120 is pressed against the fixing film 100.

Next, the operation of separating the roughening roller 120 will be described. In FIG. 6, the pressing arm 127 is provided with a spacing spring 131, one end of which is held by the fixed shaft 128 and the other end of which is held by the frame 115 (FIG. 5). The spacing spring 131 is a torsion coil spring that pre-presses the pressure arm 127 in the direction opposite to the arrow A in FIG. 6. By pre-pressing the pressure arm 127 as described above, the pressure arm 127 is urged toward the roughening roller cam 124 (FIG. 5).

Here, when the roughening roller cam 123 is rotated in order to separate the roughening roller 120, the pressing arm 127 starts to rotate in the direction opposite to the arrow A by the urging force applied by the separating spring 131. Then, the pressure arm 127 pushes the support arm 129 at the arrow B portion in FIG. 6, and therefore, the support arm 129 also rotates in the same direction in interrelation with the pressure arm 127, by which the roughening roller 120 moves away from the fixing film 100 to bring it into the separated state.

As described above, the roughening roller 120 can be moved up and down according to the rotation of the roughening roller cam 123, and it is movable between the pressing position shown in FIG. 3 where the roughening roller 120 forms the roughening nip R and the separated position shown in FIG. 4. In this embodiment, the roughening roller 120 is pressed by the total pressing force of 60N on each side by 30N at the pressing position.

In the case of this embodiment, a contacting/separating mechanism (moving mechanism) which causes the roughening roller 120 to contact or separate from the fixing film 100 is constituted by the roughening roller cam 123, the pressure arm 127, the pressure spring 130, the support arm 129, and the spacing spring 131.

Next, referring to FIGS. 3 and 5, the rotation mechanism of the roughening roller 120 will be described. In FIG. 5, the roughening roller gear 132 is connected coaxially with the roughening roller 120, and the pressure roller gear 106 is coaxially connected with the pressure roller 101.

When the roughening roller 120 is brought into contact with the fixing film 100, the roughening roller gear 132 also moves together with the roughening roller 120 to be connected to the gear 133 connected to the pressure roller gear 106. By this, the drive from the fixing device motor (not shown) is transmitted to the roughening roller gear 132 by way of the pressure roller gear 106, and the roughening roller 120 is rotated with a relative speed relative to the fixing film 100 driven by the pressure roller 101.

On the other hand, when the roughening roller cam 123 is rotated to separate the roughening roller 120 from the fixing film 100, the connection between the roughening roller gear 132 and the pressure roller gear 106 is broken. By this, the drive from the fixing device motor is not transmitted, and the rotation of the roughening roller 120 is stopped. (Backup material)

In the case of a structure in which the roughening roller 120 is brought into contact with the fixing film 100 in a roughening operation in order to recover the surface property of the fixing film 100, it is necessary to press the roughening roller 120 against the fixing film 100 at a predetermined pressure in order to obtain a sufficient roughening effect, as described above. Therefore, it is preferable to provide the back-up member 121 as an opposing member which is disposed inside the fixing film 100 and receives the pressure of the roughening roller which is pressed with a predetermined pressure.

The back-up member 121 comprises a heat-resistant resin such as liquid crystal polymer, or a soft rubber material (rubber layer) such as sponge or silicone rubber. The back-up member may have a sliding layer having a low sliding resistance as a surface layer. By this, it is possible to suppress friction with the inner peripheral surface of the fixing film 100 during the rubbing process.

However, the following findings have been made by the study of the inventors. That is, if the state where the back-up member 121 is kept in contact with the inner peripheral surface of the fixing film is maintained for a long time, the lubricant applied to the inner peripheral surface of the fixing film is scraped off, with the result of an increase in the required torque of the drive train at an early stage, leading to a shorter service life.

Therefore, in this embodiment, a clearance (separation amount) L is provided between the inner peripheral surface (inner surface) of the fixing film 100 and the back-up member 121, and the inner peripheral surface (inner surface) of the fixing film is kept out of contact with the back-up member in the period other than the rubbing process period.

Figure 7:
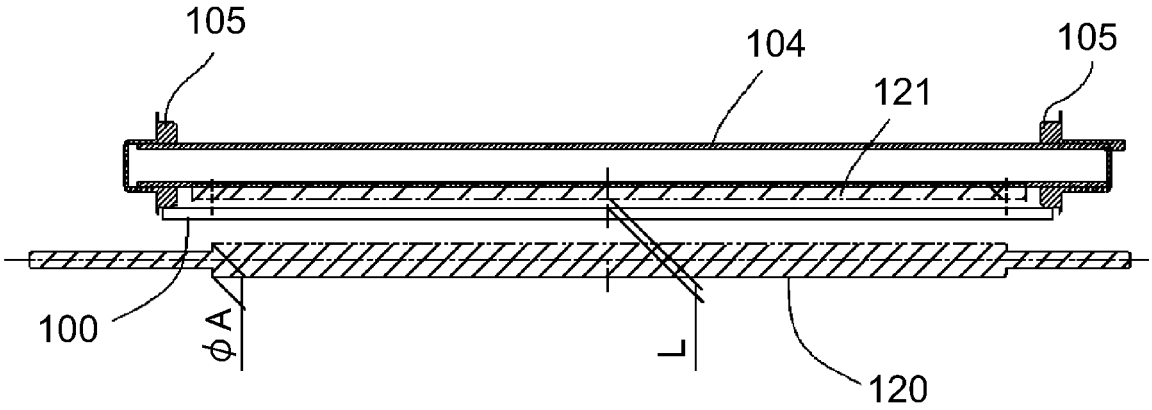
FIG. 7 is a cross-sectional view (cross-sectional view taken along a line A-A in FIG. 4) of the roughening roller and a back-up member taken along the pressing direction.

With respect to the positions of the inner peripheral surface of the fixing film 100 and the back-up member 121, the roughening roller 120 and the back-up member 121, the fixing film 100, and the film supporting member are extracted, and a cross-section of them taken along the pressing direction of the roughening roller 120 is shown in FIG. 7. Here, FIG. 7 shows an A-A cross-section in FIG. 4.

When the roughening roller 120 is brought into contact with the fixing film 100 with a predetermined pressing force, the fixing film 100 is pushed until the roughening roller 120 contacts the back-up member 121 and the fixing film 100. The fixing film 100 is deformed by the gap L from the contact point with the film supporting member at the end in the longitudinal direction as a starting point (fulcrum) (FIG. 7). Then, the roughening nip portion R (FIG. 3) is formed by sandwiching the fixing film 100 between the roughening roller 120 and the back-up member 121.

The inner surface (inner peripheral surface) of the fixing film 100 and the back-up member are separated from each other in the longitudinal direction of the fixing film 100 except during the surface property recovery operation. This is because if the back-up member 121 is in contact with the inner surface of the fixing film other than during the rubbing process, the inner peripheral surface of the fixing film may be worn. Specifically, the lubricant for preventing the friction between the heating member and the film guide and the inner surface of the fixing film is scraped off excessively, or the back-up member itself rubs against the inner surface of the fixing film, and if this occurs, the inner peripheral surface of the fixing film may be worn.

In view of this, the inner peripheral surface of the fixing film 100 and the back-up member 121 are separated from each other along the longitudinal direction of the fixing film 100 except during the surface property recovery operation. The clearance L (FIG. 7) between the inner peripheral surface of the fixing film 100 and the back-up member 121 is large enough to absorb the difference in the amplitude amount of the rotation locus between the end portion (supported by the film supporting member 105) and the central portion of the fixing film 100 in the longitudinal direction.

More specifically, the difference in the amount of amplitude of the rotation locus between the end portion and the central portion of the fixing film 100 in the longitudinal direction is 0.5 mm large at a maximum in the central portion. Therefore, the clearance L is preferably 0.5 mm or more over the entire region of the back-up member 121 in the longitudinal direction. That is, when the roughening roller 120 is in the separated position, the back-up member 121 is preferably separated from the inner peripheral surface of the fixing belt 100 by 0.5 mm or more.

The clearance L when the roughening roller 120 is at the separated position is measured in the state that the fixing film 100 forms a nip portion (nip portion during fixing processing) with the pressure roller 101 and the fixing film 100 does not rotate.

As described above, in the state the fixing film 100 forms the nip portion (nip portion at the time of fixing processing) with the pressure roller 101 and the fixing film 100 does not rotate, the back-up member 121 is not in contact with the fixing film 100. The distance L is 0.5 mm or longer.

The difference between the end/center of the amplitude amount of the fixing film 100 depends on the speed and the outer diameter of the fixing film 100, and so on, but the clearance L≥0.5 mm is enough to prevent the back-up member 121 from contacting the inner peripheral surface of the fixing film 100 even if the locus of the fixing film 100 varies. By this, the wearing of the inner peripheral surface of the fixing film by the back-up member 121 can be suppressed except during the rubbing process of the roughening roller 120, that is, when the roughening roller 120 is located at the separated position.

In order to more surely prevent the inner peripheral surface of the fixing film 100 from being worn, L≥0.8 mm is further preferable. In this embodiment, L is set to 0.8 mm as an example.

In this embodiment, when the roughening roller 120 is separated from the fixing film 100, the clearance L of the back-up member 121 from the inner surface of the fixing film 100 is constant over the longitudinal direction of the fixing film 100. Further, with respect to the longitudinal direction of the fixing film 100, the length of the back-up member 121 is shorter than the interval between the regulation surfaces on opposite end sides for regulating the longitudinal movement of the fixing film provided on the film support member 105, and longer than the length of the roughening roller 120.

By selecting the clearance L as described above, the back-up member 121 can contact the inner surface of the fixing film 100 only during the surface property recovering operation, without contacting the inner surface of the fixing film 100 except during the surface property recovering operation. Accordingly, it is possible to suppress the shortening of the life of the fixing device due to the scraping of the lubricant on the inner surface of the fixing film 100 by the back-up member 121.

As described above, according to this embodiment, the above-mentioned back-up member does not contact with the fixing film during normal printing operation, but is placed at a position where the fixing film deforms and comes into contact to the back-up member during the film roughening operation. By this, it is possible to eliminate the influence of the back-up member in the normal printing operation and provide the stable roughening effect during the film roughening operation.

Further, with respect to the longitudinal direction of the fixing film 100, the surface (area) of the back-up member 121 which can contact the inner peripheral surface of the fixing film 100 during the rubbing treatment is provided between the film supporting members 105 at the opposite ends. More specifically, it is between a portion (guide portion) which regulates the circumferential shape of the film supporting member 105 on one end side in the longitudinal direction of the fixing film 100 and a portion which regulates the circumferential shape of the film supporting member 105 on the other end side.

For the roughening roller 120, the length, measured in the longitudinal direction, of the rubbing surface (rubbing portion) for rubbing the surface of the fixing film 100 is not more than the length of the range of the back-up member 121 over which it can contact with the inner peripheral surface of the fixing film 100 during the rubbing process. By doing so, during the rubbing process, the fixing film 100 is not sandwiched between the rubbing surface of the roughening roller 120 and the film supporting member 105, so that the damage to the fixing film 100 which may be given to the fixing film 100 between the rubbing surface of the roughening roller 120 and the film supporting member 105 can be suppressed.

(Modification)

The preferred embodiments of the present invention has been described, but the present invention is not limited to such examples, and various modifications can be made within the scope of the present invention.

(Modification 1)

In the embodiments described above, the back-up member 121 provided inside the fixing film is fixedly placed in the radial direction of the fixing film 100, as viewed in the longitudinal direction of the fixing film 100. In the longitudinal direction of the fixing film 100, the back-up member 121 may be fixedly placed or may be displaceable. In addition, the present invention is not limited to the back-up member 121 fixedly placed with respect to the radial direction of the fixing film 100 as described above.

That is, the structure may be such that, the back-up member 121 is interrelated with the contacting/separating mechanism for the roughening roller 120, for example so as to move between a second separation position separated from the inner surface of the fixing film and a second contact position contacting the inner surface of the fixing film, as viewed in the longitudinal direction of the fixing film 100. That is, the second moving mechanism may set the second separated position and the second contact position at different positions in the radial direction of the fixing film.

By doing so, when the roughening roller 120 is separated from the fixing film, the back-up member 121 is in the first position separated from the inner surface of the fixing film. On the other hand, when the roughening roller 120 is in contact with the fixing film, the back-up member 121 is in the second position in which the fixing film is deformed while being supported by the supporting member 105 to contact the inner surface of the fixing film. In the longitudinal direction of the fixing film 100, the back-up member 121 may be fixedly placed or may be displaceable.

(Modification 2)

In the embodiments described above, the position where the roughening roller 120 contacts the surface of the fixing film as viewed in the longitudinal direction of the fixing film is a position displaced by 90 degrees with respect to the central position of the fixing nip portion N, but the present invention is not limited to such an example. That is, as viewed from the longitudinal direction of the fixing film, the position where the roughening roller 120 contacts the surface of the fixing film may be a lateral position displaced by a predetermined angle with respect to the center position of the fixing nip portion N.

(Modification 3)

In the above-described embodiment, the endless belt is provided on the first rotatable member of the first rotatable member and the second rotatable member forming the fixing nip portion, but the endless belt may provided on the second rotatable member. Further, the endless belt may be provided on each of the first rotatable member and the second rotatable member.

(Modification 4)

In the embodiment described above, the pressure roller 101 may be rotationally driven, and the fixing film 100 may be driven to rotate by friction with the rotating pressure roller 101, but the fixing film 100 may be rotationally driven. In such a case, for example, the film supporting member 105 on one side of the fixing film 100 is a gear fixed to the fixing film 100, and the drive of the motor is transmitted to this gear.

(Modification 5)

In the above-described embodiment, the surface (area) of the back-up member 121 which can contact the inner peripheral surface of the fixing film 100 during the rubbing process has been described as being between the film support members 105 at both ends. However, the positional relationship in the longitudinal direction is not limited to this example. For example, when the back-up member is provided at a position where it does not interfere with the film support members 105 at both ends, the back-up member 121 may be structured to extend outside the film support members 105 at the opposite ends.

(Modification 6)

In the above-described embodiment, the sheet P as a recording material on which a toner image is formed is described as plain paper, a resin sheet-like substitute for plain paper, thick paper, an overhead projector sheet, or the like. More specifically, for example, regular or irregular paper, thick paper, therein paper, envelopes, postcards, stickers, resin sheets, OHP sheets, glossy paper and the like are included. In the above-described embodiment, the handling of the recording material (sheet) P has been described using terms such as sheet feeding and paper discharging for convenience, but the recording material in the present invention is not limited to paper.

(Modification 7)

In the above-described embodiment, the device for fixing the unfixed toner image on the sheet has been described as an example, but the present invention is not limited to this example. The present invention is similarly applicable to a device which heats and presses the toner image temporally fixed on the sheet to improve the gloss of the image (also referred to as a fixing device).

According to the present invention, there is provided an electrophotographic type image forming apparatus including a fixing device using an endless belt and capable of forming an image on a recording material, such as a copying machine, a printer, a facsimile, and so on.

The present invention is not limited to the above embodiments, and various changes and modifications can be made without departing from the spirit and scope of the present invention. Therefore, the following claims are attached to open the scope of the present invention.

The present application claims priority based on Japanese Patent Application No. 2018-042749 filed on Mar. 9, 2018, and the entire contents of the description are incorporated herein.

The invention claimed is:

1. A fixing device comprising:

an endless belt;

a driving rotatable member cooperative with said endless belt to form a nip for fixing a toner image on a recording material and configured to drive said endless belt;

an urging member provided inside said endless belt and configured to urge said endless belt toward said driving rotatable member;

a metal stay configured to support said urging member;

a rubbing rotatable member configured to carry out a rubbing treatment to rub an outer surface of said endless belt; and a back-up member fixed to one surface of said metal stay and configured to back said rubbing rotatable member up by way of said endless belt when the rubbing treatment by said rubbing rotatable member is carried out, wherein when the rubbing treatment by said rubbing rotatable member is carried out, said metal stay is configured to back up a side opposite to a side on which said back-up member backs up said rubbing rotatable member via said belt.

2. The device according to claim 1, further comprising a moving mechanism configured to move said rubbing rotatable member between a first position in which said rubbing rotatable member contacts said endless belt and a second position in which said rubbing rotatable member is separated from said endless belt, wherein when said the rubbing rotatable member is in the second position, said back-up member does not contact an inner surface of said endless belt.

3. The device according to claim 2, wherein when said rubbing member is in the second position, said back-up member is separated from the inner surface of said endless belt by not less than 0.5 mm.

4. The device according to claim 1, wherein in a longitudinal direction of said fixing device, a length of said rubbing rotatable member is not more than a length of an area in which said back-up member contacts said endless belt.

5. The device according to claim 1, wherein a surface of said rubbing rotatable member is provided with #1000-#4000 grain.

6. The device according to claim 1, wherein said rubbing rotatable member has a surface roughness Ra of not less than 2.0 μm and not more than 4.0 μm.

7. The device according to claim 1, wherein said urging member is provided with a planar heater for heating by energization.

* * * * *